US005960735A

United States Patent [19]

Geiger

[11] Patent Number: 5,960,735

[45] Date of Patent: Oct. 5, 1999

[54] INTRA-BONDED BOAT STRUCTURAL DESIGN FOR REDUCING WEIGHT WITH INCREASED STRENGTH

[76] Inventor: Joseph Thomas Geiger, 600 6th Ave. (Tropic Branch), Vero Beach, Fla. 32962-9998

[21] Appl. No.: 08/824,080

[22] Filed: Mar. 24, 1997

[51] Int. Cl.[6] ..... B63B 7/00

[52] U.S. Cl. ..... 114/355

[58] Field of Search ..... 114/361, 355, 114/356, 357, 358

[56] References Cited

U.S. PATENT DOCUMENTS 4,729,334 3/1988 DeJean ..... 114/361
5,458,844 10/1995 MacDougall ..... 114/357

*Primary Examiner*—Stephen Avila

[57] ABSTRACT

A structural design method that supplies the needed internal structural strength for a boat hull that eliminates the need for a rib/stringer (horizontal and longitudinal) structural stiffeners in a boat hull.

8 Claims, 2 Drawing Sheets

INTRA-BONDED BOAT STRUCTURAL DESIGN FOR REDUCING WEIGHT WITH INCREASED STRENGTH

TECHNICAL FIELD

This invention relates to the interior structural design of a non-flexible made of cored fibrous reinforced plastic, or other material, boat hull where in a system that bonds together "Intra-Bonds" the normally required bulkheads, cabin sole, interior walls and cabinetry and then fastens and/or bonds all of the above items to the hull shell in such a way as to eliminate the need for a dedicated internal hull structural system of ribs and stringers, i.e. horizontal and longitudinal stiffeners.

BACKGROUND ART

Most, if not all commercially available power and sail boat hulls of 25 feet or more are designed around a frame of ribs and stringers, covered on the outside with a non-porous skin of fabric, wood, metal, fibrous reinforced plastic (FRP) or other non porous material. Examples range from a birch bark canoe to the modern aircraft carrier. Historically boat construction begins with the building of a keel to which ribs and parallel stringers are attached. The outer water proof skin is then attached to the ribs and stringers. In modem fiberglass construction the outside skin, in the form of a resin impregnated fibrous cloth, mat or spray chopped strand is applied to the inside walls of a mold and then a grid system of longitudinal stringers and full width or stud ribs is bonded to the inside of the skin. In both cases the rib and stringer system is the structural strength of the resulting boat hull shell.

Ribs are evenly spaced, parallel, side to side primary structural members to which are fastened or bonded the hull skin. Ribs maintain the beam, shape and strength of the hull's cross section, preventing it from collapsing inward when under load stress.

Stringers are primary longitudinal structural stiffening members placed parallel to each other and running from the bow to the stem of the boat. All stringers do not always run the entire length of the boat. To the stringers are fastened or bonded the ribs and hull skin. Stringers supply strength to the length of the hull preventing it from bending from bow to stem, like a fishing rod, when under load stress. When combined together this rib/stringer system is the primary strength of the hull, without which the hull would be unable to hold its design shape when under way in heavy seas.

All of the known mid sized and larger boat hull building systems require some form of rib/stringer system for their primary hull strength on a longitudinal and horizontal axises. All of the known power and sail boat hulls above 25' in length would not be sea worthy if the rib/stringer system was removed.

Some small specialty boat have been molded by the rotary molding method as described by U.S. Pat. No. 5,458,844 where in a simple inner liner or shell with stringers, i.e. longitudinal stiffeners, are integrated into the shape of the inner liner and attached by some method to the molded hull. In U.S. Pat. No. 5,458,844 " claim #1 column 6 lines 37 to 39 states ". . . at least one of said moulds being shaped to create a stiffening member in a shell structure formed in said moulds", and column 6 lines 7 to 14, "By forming a hull of a boat as an integral unit with one or more internal stiffening members formed homogeneously with inner or outer shells of the hull, a reliable hull structure can be achieved overcoming problems of failure at joints inherent in conventional designs with bonded or mechanical joining methods. In other words this patent is a method of attaching the "internal stiffening members" so that a ". . . reliable hull structure can be achieved overcoming problems of failure at joints . . . ". The Geiger invention require no "longitudinal stiffening member" in the hull. In rotary molding, both hull and inner liner are normally made of the same material and bonded together by melting (welding) the plastic material together. U.S. Pat. No. 5,458,844 is a variation of the more common practice of mechanically fastening or bonding two rotary molded part together, where in the interior part is shaped in such a way that the required longitudinal stiffening members are incorporated in and made part of the hull or inner liner's shape as clearly illustrated in FIG. 2 item Nos. 28, 29 and 30.

The rotary molding method is adequate for dingy, canoes, kayaks, small sail boats, small outboards or "Jet Skies" etc. but totally impractical for large sea going vessel where twin 1,000 hp to 5,000 hp diesel engines that can weigh over 20,000 pounds each are common. In addition the rotary molding method pre-supposed a very simple interior, not one that incorporates multiple bed rooms, heads, dinning areas and other highly finished living areas. In addition it is unlikely that a mold 100' long by 25' wide by 15' deep that incorporates a lavish yacht interior or complex work boat or military boat interior could be built into a rotary mold, evenly heated and rotated in the manor required for rotary mold manufacturing.

Several other U.S. Patents have been issued that apply to commercial fishing boat arrangements such as U.S. Pat. Nos. 4,033,280 and 4,729,334. However, these Patents are for interior fishing boat deck, cabin shape and space arrangements not for hull structural design. The only places in U.S. Pat. No. 4,729,334 that hull structure is even mentioned are: column #4 lines 8 to 13 where the inventor states that ". . . although wood or metal, such as aluminum may be used in fabricating the hull, deck and cabin a fiberglass reinforced synthetic resin over a wood or metal frame is generally preferred", and column 4 lines 16 to 19 ". . . it (hull, deck and cabin) can be fabricated readily using relatively inexpensive molds and simple hand lay-up or spray-up methods "well known in the boat building industry." In other words the inventor envisions that the boat will be built using present day techniques that are "well known in the boat building industry". The only boat structural design system that is "well known in the boat building industry" today requires the installation of ribs and stringers for hull structural strength which is the ". . . the wood or metal frame . . . " that is mentioned in column #4 lines 8 to 13.

The Geiger invention is an alternative method of boat design and construction that overcomes the requirement for a horizontal and longitudinal structural support system of ribs and stringers, by building a very ridged non-flexible hull shell out of composites, consisting of a fibrous reinforced plastic skins bonded on either side of a light weight core material, then fastening or bonding the normally required decks, bulkheads, cabin sole, interior walls and cabinetry to this hull in such a way as to make the need for an dedicated internal structural system of horizontal and longitudinal stiffeners, i.e. ribs and stringers, unnecessary. At the present time a number of coring materials are available. Among them are cross-link foam such as Divinycell, linear foam such as CoreCell, end grain balsa, and honey comb make of aluminum, plastic or Nomex. A relatively thick laminate of carbon fiber or a very thick fiberglass laminate could produce a non-cored shell ridged enough to be use with the Intra-Bonding Structural Design System.

SUMMARY AND ART OF THE INVENTION

A marine structural design system, "INTRA-BONDING" comprised of: (a) A very stiff, non-flexible hull shell of one or more layers of fibrous reinforced plastic bonded on both sides of a thick core material, or any other material that results in a very ridged, non-flexible self supporting hull shell, (b) fastening and/or bonding the cabin sole including the sub-floor supports, and all bulkheads directly to the hull shell thus forming the primary integral structure, (c) fastening or bonding all decks including the cockpit, cabin walls, galley, dinette, and other cabinetry one to the other and to the hull and other structure in all places where they intersect, thus intra-bonding all inside structures together to form the frame of the boat, (d) wherein the vessel eliminated the need for a rib/stringer system and its attendant cost and weight, and (e) becomes a single integrated unit that (f) has superior strength and stiffness which will, (g) be very resistant to interior damage caused when driven through a rough seaway, and (h) reducing interior damage if the vessel is grounded and (i) will reduce the power required to achieve a predetermined boat speed compared to traditional rib/stringer vessels and j) making the boat more fuel efficient at any speed while (k) reduce the complexity of construction by (l) eliminating the dedicated rib/stringer system.

The main point of the "Intra-Bonding" System is that no dedicated rib/stringer, i.e. horizontal and longitudinal, structural system, it's attendant cost and manufacturing complexity is required to achieve large boat structural integrity, strength or maintain design shape of the hull when the hull is subjected to very high stress as it is when driven at high speed into very rough seas.

INDEX OF THE DRAWING NUMBERS

In an effort to simplify understanding of the drawings the following index of the various boat parts are defined as follows:

1. Hull
2. Forward Deck
3. Cockpit
4. Bridge Deck
5. Cabin Sole (floor)
6A. Aft Engine Room Bulkhead
6B. Forward Engine Room Bulkhead
6C. Cabin Bulkhead
6D. Anchor Room Bulkhead
7A. Aft Cabin & Head Wall
7B. Forward Head Wall
8A. Shelf, Vanity in Head
8B. Shelf, Galley Top
8C. Shelf, Dinette Seat
8D. Shelf, Forward Berth Top
9A. Cabinet Front, Galley
9B. Cabinet Front, Head
10. Dinette Platform
11. Intra-bond Connections
12. Hull to Deck connection Bond
13. Cabin Sole (floor) Joyce
14. Engine Beds

BRIEF DESCRIPTION OF THE DRAWINGS

The following is a description of the numbered Intra-Bonded parts as they appear in FIG. 1 and FIG. 2, plus how they are intra-bonded (secured) in a generic FRP (Fibrous Reenforced Plastic) boat. The hull #1 is shown only on FIG. 1. The deck #2 is shown only on FIG.2. The cockpit deck #3 and bridge deck #4 are bonded to all intersecting parts including the hull #1, and both engine room bulkheads #6A and #6B with one or more layers of FRP as shown in FIG. 1 and 2. The cabin sole (floor) #5 is bonded to all intersecting parts, including the hull #1, the cabin bulkhead #6B and #6C, plus the cabin walls #7A and #7B, the dinette platform #10 and the floor Joyce #13. All bulkheads #6A to #6D are bonded to all intersecting parts including the hull #1, decks #2, #3 and #4, cabin sole #5, shelving #8A to 8D, cabinet-front #9A, cabin sole #10 and engine beds #14. All walls #7A and #7B are bonded to all intersecting parts including #1, #2, #5, #8A, #8B, #9A, #9B and #10. All shelves #8A to #8D are bonded to all intersecting parts including #1, #6C, #6D, #7A, #7B, #9A, and #9B. The cabinet fronts #9A and #9B are bonded to all intersecting parts including #6C, #7A, #7B, #8A, and #8B. The dinette platform #10 is bonded to all intersecting parts including #1, #5, #6C, #7A, and #7B. All intersection bonds #11 have fillets with a triangular cross section of about 1"×1"×1½". The fillet's cross section is designed to soften the parts joint angle, thus improving the bond when it is made with one or more layers of FRP. The hull and deck are securely bolted and glued at #12 an overlapping joint (shoe box joint) then bonded on the inside of the joint with one or more layers of FRP. Under the cabin sole (floor) #5, floor supports #14 are bonded to #1 and #5. The engine beds #14 are bonded to the #1, #6A and #6B as strongly as possible. High power engines may need additional cross ship bracing bonded between the engine beds and to the hull to prevent torsional bending.

DETAILED DESCRIPTION FOR CARRYING OUT THE INVENTION

Figure 1:
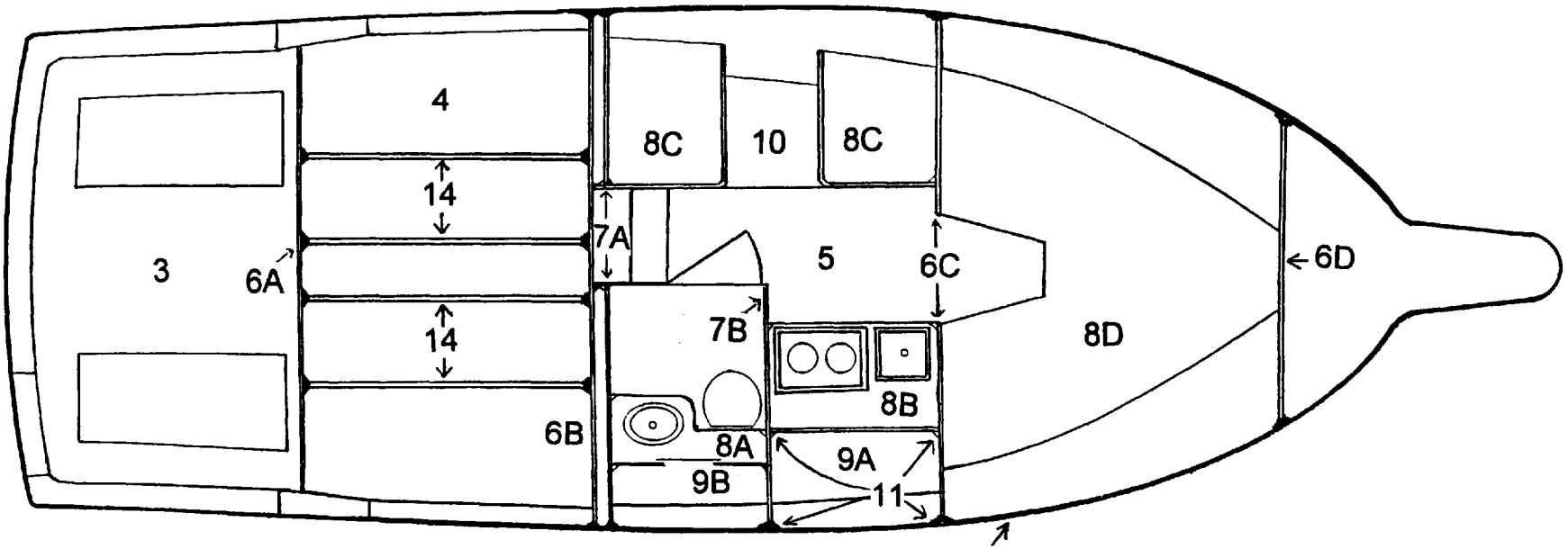
Figure 2:
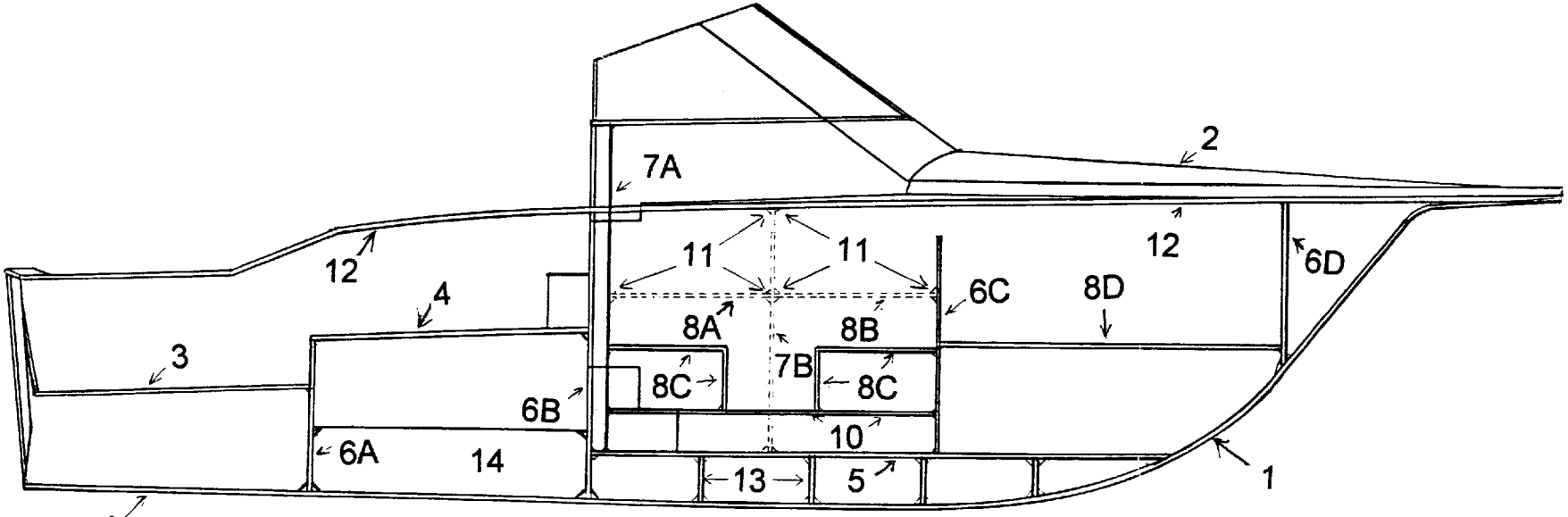

For best results the Intra-Bonding System requires a light weight, very stiff, non-flexible hull shell. Current technology achieves a light weight and stiff hull shell with one or more layers of FRP bonded on both sides of a thick core of balsa, foam, various honeycomb materials, or light expanded resin material, thus forming a self supporting hull shell. A relatively thick laminate of carbon fiber or very thick fiberglass laminate would produce a non-cored laminate shell ridged enough to use with this structural design system invention, but at an increase in weight and cost thus reducing the Inter-Bonding Systems weight savings and performance advantages.

The Intra-Bonded Structural System supplies additional hull strength and stiffness by fastening and/or bonding all bulkheads to the hull shell as securely as possible thus dividing the hull into compartments i.e. aft cockpit, engine room, main cabin, forward cabin and anchor locker. Bulkhead spacing is not critical and may be offset when crossing the hull. The bulkheads form part of the primary internal structure. Blind joints should be avoided as much as possible because very secure and ridged attachment of all parts is a very important component of this system.

The Intra-Bonded Structural System additionally requires that all cabins have a cabin sole (floor) that is fastened and/or bonded as securely as possible to the hull shell, any sub-floor supports and all intersecting bulkheads. The cabin sole thus forms a second bottom to the boat, becomes part of the primary internal structure and will carry considerable working loads.

All interior bulkheads, cabinetry, fixed tables, shelves, berths, and interior decks (if any) are fastened and/or bonded one to the other and to the hull, top deck and cabin sole so that any load that is applied against one part of the boat is transferred to all other parts of the boat.

Every effort should be made to design the counter tops, dinette seats, berth tops and cabinet shelving in such a way that the hull sides are supported by one or more rings of shelving. It is not necessary for the shelving rings to be continuous or maintain the same elevation around the entire hull sides. It is necessary for the cabinetry to be security fastened or bonded at every intersection to every other part of the boat that is contacted. The shelving thus become part of the interior structure, carry and transfer their share of the working loads of the boat.

Interior cabin and closet walls are fastened and/or bonded as securely as possible to the hull shell cabin sole, all intersection shelving and other interior parts. The walls thus become part of the interior structure and carry and transfer their share of the working loads of the boat.

The cockpit and bridge deck must be fastened and/or bonded as securely as possible to the hull shell at the deck level, to all intersecting bulkheads and cockpit dividers at the deck level, thus become part of the interior structure and carry and transfer their share of the working loads of the boat. Decks should not be simply hung from the hull sides or from the hull sheer or gunwale as is the current common industry method, but must be secularly fastened or bonded at the deck level. For best results all decks should be constructed as stiff, strong and light as possible. Current technology achieves such a ridged light weight deck structure with one or more layers of FRP bonded to both sides of a thick interior core of balsa, foam, honeycomb, or light expanded resin material thus forming a self supporting part.

The final component of the Intra-Bonded Structural System is the top deck. This deck must be constructed very ridged, then fastened and/or bonded as securely as possible to the hull shell, all intersecting bulkheads, cabin walls and any intersecting cabinetry parts thus becomes part of the interior structure, carries and transfers their share of the working loads of the boat.

The Intra-Bonding System distributes working loads through out the entire boats hull, deck, and interior instead of concentrating them in the rib/stringer system, thus the boats cabin sole, bulkheads, decks, interior cabinetry and walls become the frame. The Intra-Bonding System vertically eliminates the hulls movement or "working" that traditional rib/stringer designed boat hulls experience when being driven through a heavy seaway. Because the Intra-Bonded Structural System is far more ridged than the traditional rib/stringer system, the Intra-Bonded boat is much less susceptible to interior damage from the normal hull "working" movement that is expected by boats constructed with the current rib/stringer system.

The Intra-Bonding System, when properly executed, will reduces the boats over all weight, construction complexity, and in most cases, the cost of the vessel by eliminating the entire rib/stringer system. Compared to traditional rib/stringer solid fiberglass boats a 50% reduction in finished boat weight and a 100% decrease in power required is achievable.

I claim:

1. The named marine structural system solidly fastens and/or bonds the hull, deck, cabin sole, cockpit, bulkheads, cabinet walls, galley, dinette, and other cabinetry one to the other, thus becoming the frame and forming a very light stiff and strong boat hull.

2. The named marine structural system, by implementing claim 1, will eliminates the need for a rib/stringer system to supply the basic structural strength of a boat hull.

3. The named marine structural system, by implementing claim 1, will improves the vessels resistant to interior damage caused when driven through a rough seaway.

4. The named marine structural system, by implementing claims 1, will have superior boat strength and stiffness thus reduces the vessels interior damage if the vessel is grounded.

5. The named marine structural system, by implementing claims 1, will reduces the complexity of boat hull construction by eliminating the dedicated rib/stringer system.

6. The named marine structural system, by implementing claims 1, will reduces the total weight of the completed boat.

7. The named marine structural system, by implementing claims 1, will reducing the power required to achieve a predetermined boat speed compared to traditional rib/stinger designed boats.

8. The named marine structural system, by implementing claims 1, will increased the vessels fuel efficiency.

* * * * *